US007198548B1

(12) United States Patent
Chen

(10) Patent No.: US 7,198,548 B1
(45) Date of Patent: Apr. 3, 2007

(54) POLISHING APPARATUS AND METHOD WITH DIRECT LOAD PLATEN

(75) Inventor: Hung Chih Chen, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/241,254

(22) Filed: Sep. 30, 2005

(51) Int. Cl.
*B24B 49/00* (2006.01)

(52) U.S. Cl. ..... 451/11; 451/286

(58) Field of Classification Search ..... 451/9–11, 451/6, 57, 65, 285–289, 41
See application file for complete search history.

(56) References Cited

U.S. PATENT DOCUMENTS 5,238,354 A 8/1993 Volovich
5,616,603 A 4/1997 Borrett
5,738,574 A 4/1998 Tolles et al.
5,993,302 A * 11/1999 Chen et al. ..... 451/285
6,146,256 A * 11/2000 Joo ..... 451/285
6,213,847 B1 * 4/2001 Torii ..... 451/8
6,436,228 B1 * 8/2002 Zuniga et al. ..... 451/285
6,614,256 B2 9/2003 Bonduel et al.
6,817,923 B2 * 11/2004 Smith ..... 451/5
2002/0179251 A1 12/2002 Zuniga

* cited by examiner

*Primary Examiner*—Dung Van Nguyen
(74) *Attorney, Agent, or Firm*—Fish & Richardson

(57) ABSTRACT

A method and apparatus for chemical mechanical polishing includes a platen supports a polishing article, a robot located proximate the platen, a carrier head having a retaining ring, and a carrier heads support mechanism. The robot is configured to position a substrate on the polishing article, and the carrier heads support mechanism is configured to move the carrier head into a position that the retaining ring surrounds the substrate.

37 Claims, 8 Drawing Sheets

POLISHING APPARATUS AND METHOD WITH DIRECT LOAD PLATEN

BACKGROUND

This present invention relates to chemical mechanical polishing apparatus and methods.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) by a polisher is one accepted method of planarization. A conventional polisher includes a base with several polishing stations and a loading port. The loading port is typically dedicated to providing a precise position for chucking by a carrier or polishing head. After chucking the substrate from the loading port, the polisher may move the substrate to one or more of the polishing stations for processing. During planarization, the exposed surface of the substrate is placed against a polishing surface of a polishing pad, such as a rotating polishing disk or linearly advancing belt. The carrier head provides a controllable load on the substrate to push it against the polishing pad. A polishing liquid, which can include abrasive particles, is supplied to the surface of the polishing pad, and the relative motion between the substrate and polishing pad results in planarization and polishing.

Conventional polishing pads include "standard" pads and fixed-abrasive pads. A typical standard pad has a polyurethane polishing layer with a durable roughened surface, and can also include a compressible backing layer. In contrast, a fixed-abrasive pad has abrasive particles held in a containment media, and can be supported on a generally incompressible backing layer.

Overall, the process of forming an integrated circuit can be prohibitively and increasingly expensive. One major factor in expense is the necessary size of a conventional semiconductor fabrication plant that includes numerous processing machines other than the polisher. Each of the machines consume a certain area of the floor, known as a footprint. In particular, the loading port of a polisher can consume up to a quarter of a polisher footprint. Another major factor in expense is the amount time needed for the numerous steps in processing. Time of processing affects throughput, or production volume. Moreover, many steps require a handoff which can spoil a substrate through damage.

SUMMARY

This disclosure generally describes systems, methods, computer program products, and means for a chemical polishing apparatus. In general, a chemical polishing apparatus can load (and unload) a substrate directly on a polishing article or platen from which the substrate can be chucked by a polishing head.

In one aspect, the invention is directed to a chemical mechanical polishing apparatus. The apparatus includes a carousel having N polishing heads, N platens and a robot. The N polishing heads positioned at substantially equal angles around an axis of rotation of the carousel. Each of the N platens is configured to support a polishing article, and the N platens are positioned at substantially equal angles around the axis of rotation of the carousel, such that each polishing head can position a substrate in contact with a polishing article at an associated platen. The N platens include a loading platen, and the robot is located proximate to the loading platen and is configured to position a substrate on the polishing article at the loading platen for loading into a polishing head from the N polishing heads.

Implementations of the invention may include one or more of the following. The N polishing heads may be rotatable. The robot may be configured to position the substrate only at the loading platen, or be configured to position the substrate at one of a plurality of platens from the N platens. The robot may be configured to retrieve a substrate from the loading platen, or be configured to retrieve a substrate from a platen other than the loading platen. Another robot may be located proximate to a second platen other than the loading platen and may be configured to position a substrate on the polishing article at the second platen for loading into another polishing head from the N polishing heads. A first positioning sensor may notify the robot that a substrate has reached a first desired position along a first dimension associated with the loading platen. A second positioning sensor may notify the robot that a substrate has reached a second desired position along a second dimension associated with the loading platen. The first positioning sensor may be coupled to the robot, or is coupled to one or more of the carousel or carrier head. A controller may be in communication with the first positioning sensor and the robot, and the controller may configured to receive a feedback signal from the first positioning sensor responsive to a position and, in response, send a position signal to the robot that directs movement of the robot. The apparatus may include a means for adjusting a position of a substrate after being released by the robot and before being chucked by one of the N polishing heads. A retaining ring in the carrier head may be configured to adjust from a first diameter to a second diameter that is smaller than the first diameter. The adjustable ring may be configured to unload the substrate by adjusting from the second diameter to the first diameter. The loading platen may include a set of alignment pins to more accurately position the substrate for loading by repositioning the substrate. The alignment pins may be retractable into the platen. A spacing between inner surfaces of the alignment pins may provide a dimension that is larger at a top than a bottom of the alignment pints. The loading platen may be rotatable to a loading position for access that is not obstructed by the carrier head, and may be rotatable to a chucking position for access by the carrier head. The carousel and the N platens may each be coupled to the base for support.

In another aspect, the invention is directed to a chemical mechanical polishing apparatus that includes a polishing head, a platen configured to support a polishing article, a robot located proximate to the platen and configured to position a substrate on the polishing article, and an adjustment mechanism to engage the substrate at a first position and reposition the substrate to a second position. The second position is within a range of positions for a polishing head to chuck the substrate from the loading platen, and the first position includes positions that are out of range.

Implementations of the invention may include one or more of the following features. The adjustment mechanism may include a retaining ring configured to adjust from a first diameter to a second diameter that is smaller than the first diameter. The adjustment mechanism includes a set of alignment pins retractable into the platen. The platen may be rotatable to a loading position for access that is not obstructed by the carrier head, and the loading platen may be rotatable to a loading position for access by the carrier head.

In another aspect, the invention is directed to a chemical mechanical polishing apparatus that includes a platen to support a polishing article, a robot located proximate the platen and configured to position a substrate on the polishing article, a carrier head having a retaining ring, and a carrier head support mechanism configured to move the carrier head into a position that the retaining ring surrounds the substrate.

In another aspect, the invention is directed to a method of operating a polishing system. The method includes placing a substrate onto a polishing surface with a robot, bringing at least a portion of a carrier head into a loading position such that a retaining ring of the carrier head surrounds the substrate, and causing relative motion between the carrier head and the polishing surface so as to polish the substrate.

Implementations of the invention may include one or more of the following features. The substrate may be placed onto the polishing surface at a first position, and the substrate may be moved from the first position to the loading position. Moving the substrate may include adjusting a diameter of an inner surface of the retaining ring, contacting an edge of the substrate with an alignment pin, or moving the platen. The substrate may be chucked with the carrier head, the carrier head may move with the substrate to another polishing surface, and the substrate may be polished with the another polishing surface.

Implementations of the invention can include one or more of the following advantages. The apparatus, without a need for a dedicated load port, can have a reduced footprint within a fabrication facility. Moreover, by obviating a handoff, the apparatus can have a higher throughput and experience fewer losses from machine damage. As a result, the apparatus can reduce expenses incurred in connection with a semiconductor fabrication plant.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
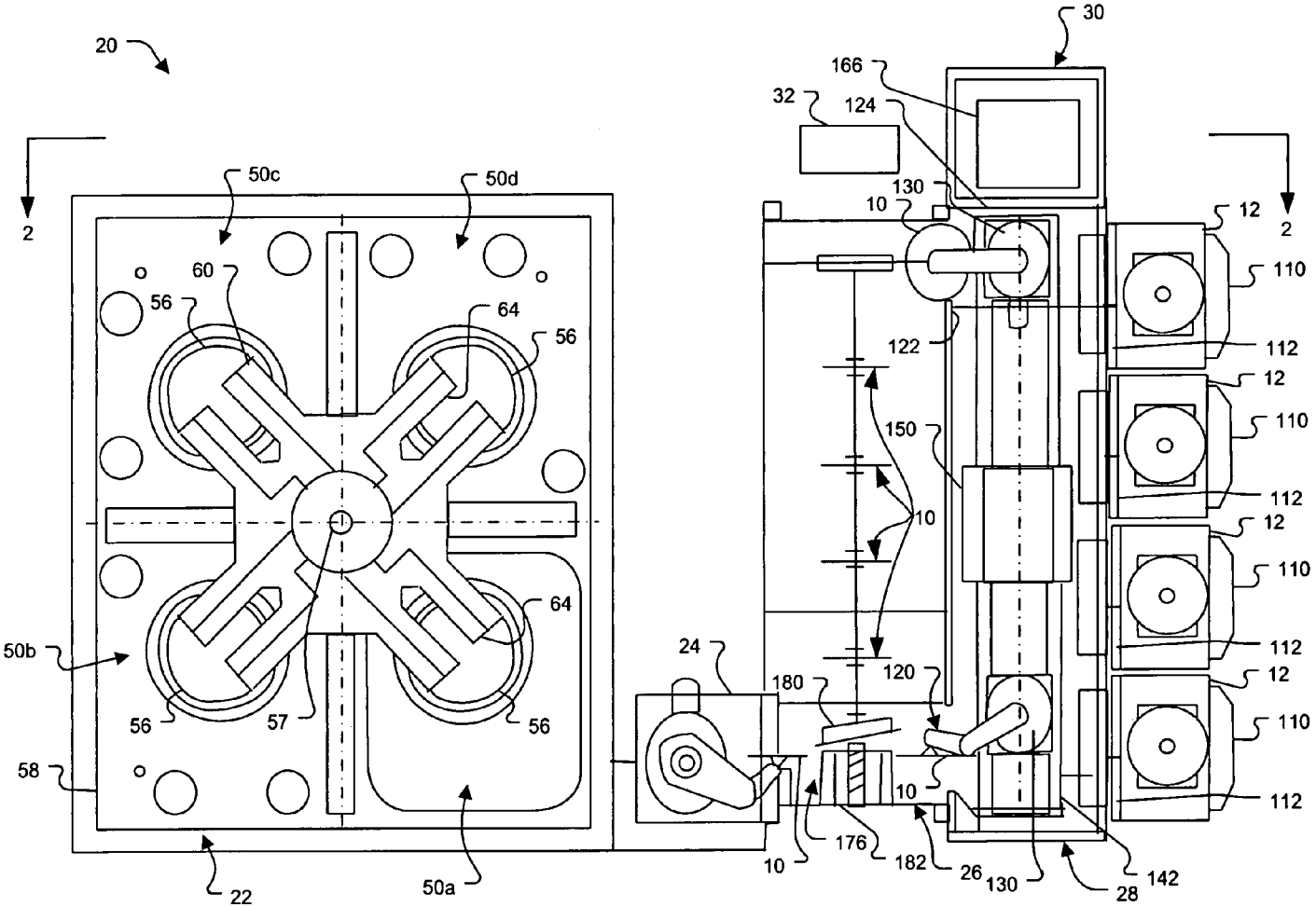
FIG. 1 is a schematic top views illustrating an implementation of a system to process substrates.

FIG. 1 is a schematic diagram illustrating a system 20 to process substrates (e.g., planarization) in a semiconductor fabrication plant. The substrate processing system 20 includes a chemical mechanical polishing apparatus ("polisher") 22, a wet robot ("robot") 24, a cleaner 26, a factory interface module 28, and a controller 32. The system 20 can include optional components such as metrology devices or particle monitoring systems. The substrates 10 can be, for example, silicon wafers (e.g., used to form integrated circuits) or other objects processed in the system 20. Generally, the substrates 10 are transported to the system 20, with the assistance of the robot 24, for planarization or polishing by the polisher 22, and cleaning by the cleaner 26. FIG. 1 illustrates an exemplary system 20 that is implementation-specific since the polisher 22 can be implemented in other systems and exchange substrates 10 with the system 20 through other methods.

The factory interface module 28, in one implementation, can be rectangular in shape. Several cassette support plates 110 (e.g., four) project from the factory interface module 28 into the clean room to accept cassettes 12. The cassettes 12 are used to protect the substrates during transport around a semiconductor fabrication plant and within the system 10. A plurality of cassette ports 112 permit transport of the substrates 10 from the cassettes 12 into and out of the factory interface module 28.

A factory interface robot 130 can be positioned on a rail 142 that extends linearly within the factory interface module 28. The factory interface robot 130 can travel along the rail 142 to move the substrates 10 between processes (e.g., to polishing or to cleaning). Specifically, the factory interface robot 130 can move the substrates 10 from a cassette port 112 to a staging section 176 at an access port 120. Additionally, the factory interface robot 130 can move the substrates 10 the cleaner 26 at an access port 122 back to a cassette port 112.

The robot 24 is positioned between a staging section 176 and the polisher 22. In one implementation, the robot 24 is coupled to, e.g., supported on the base of, the polisher 22. In another implementation, the robot 24 can be a separate apparatus. The robot 24 transports the substrates 10 between the staging section and the polisher 22. In the staging section 176, the substrates 10 can be accessed by the robot 24 from an indexable buffer 182. The robot 24 includes a substrate gripper, such as a blade 141, that is horizontally movable over the platen 54.

The polisher 22 includes polishing stations (e.g., four station 50*a*–50*d*, although there may be a different number of stations) and a carousel 60 supported above the polishing stations. The polishing stations 50*a*–50*d* can be placed at substantially equal angular intervals around, and at substantially equal distances from, an axis of rotation 57 of the carousel 60.

Figure 2:
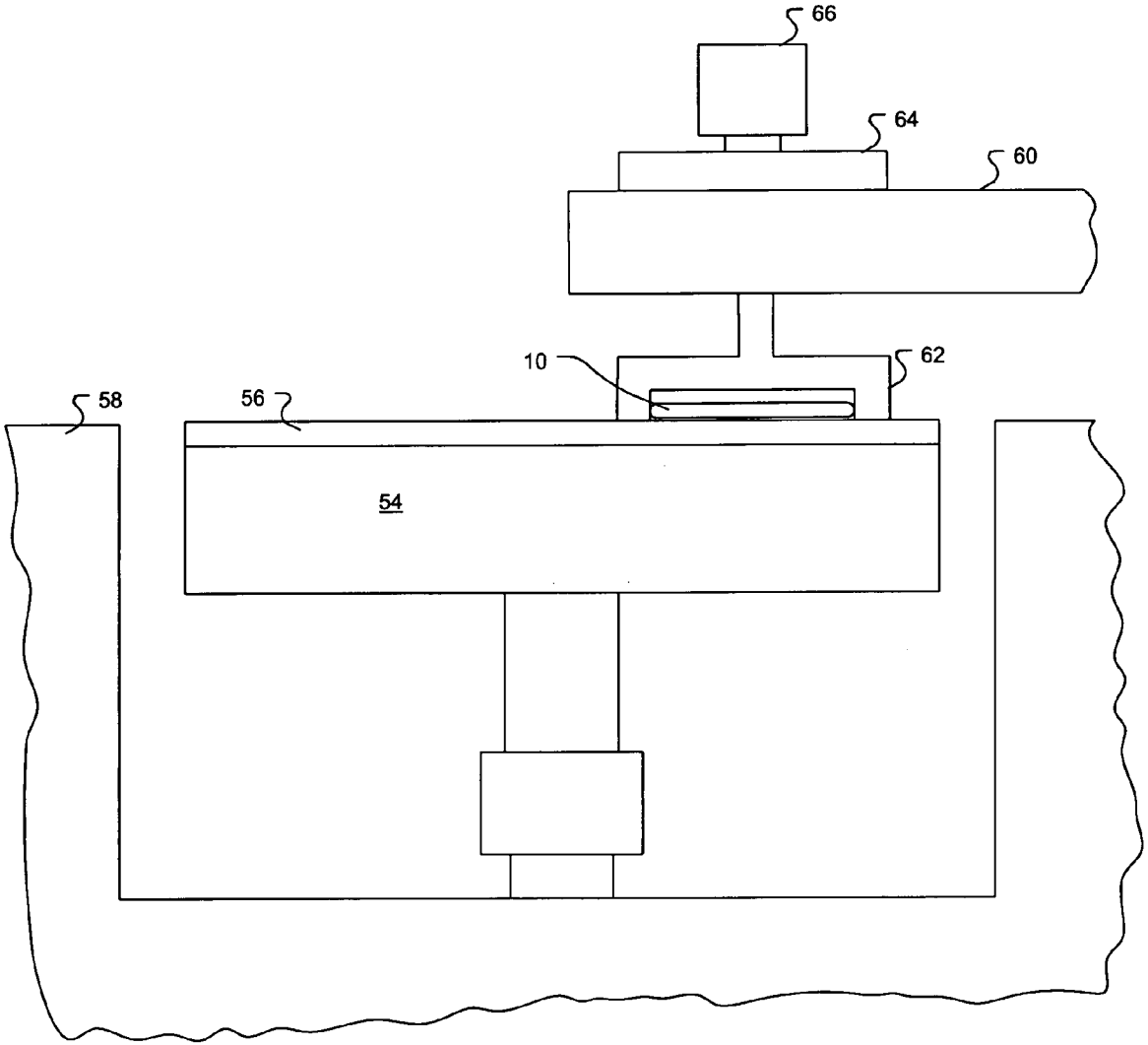
FIG. 2 is a schematic cross-sectional side view illustrating a polishing station from the system of FIG. 1.

As shown in FIG. 2, each of the polishing stations 50*a*–50*d* includes a platen 54 supported by a common base 58. Each polishing station can also optionally include, for example, washing stations, pad conditioners, and the like.

Each platen supports a polishing article 56. The polishing article 56 can be, for example, a standard or a fixed-abrasive or a polishing pad. Alternatively, one or more polishing stations can use a continuous belt or an incrementally advanceable sheet rather than a circular polishing pad. The platen 54 can be circular and can be rotatably mounted and driven by a motor. In operating, the platen 54 rotates to create relative motion between the substrate and the polishing surface which, in combination with the slurry, smooths the surface of the substrate 10.

Referring to FIGS. 1 and 2, the carousel 60, in one implementation, is cross-shaped with the carrier heads 62 (e.g., four) spaced at substantially equal angular intervals (e.g., at 90-degree intervals) around an axis of rotation 57 of the carousel (the carrier heads are not shown in FIG. 1 so that the polishing articles can be shown with greater clarity). The support rails 64 that hold the carrier heads 62 can also be located at substantially equal distances from the axis 57, and each carrier head 62 can be independently movable along the support rail 64 to travel linearly and radially toward or away from the axis 57. In the implementation shown, a number of carrier heads 62 (e.g., N carrier heads 62) on the carousel 60 equals a number of polishing stations 50 (e.g., N polishing stations 50). The carrier heads 62 secure the substrates 10, for example, by vacuum chucking or by a retaining rings. The carousel 60 rotates about the axis 57 to transport the carrier heads 62 with the substrates 10 between the polishing stations 50. Each carrier head 62 can be vertically movable, or include a vertically movable lower portion, as to be able to lower the chucked substrates 10 to polishing stations 50 for processing. In addition, each carrier head can be independently rotatable, e.g., by a motor 66.

The cleaner 26, in one implementation, is a rectangular-shaped cabinet. A pass through support 180 can retrieve the substrates 10 from the indexable buffer 182. Generally, the cleaner 26 washes the substrates 10 after planarization to remove excess debris.

For loading of the substrate into the polisher, the robot 24 can be configured and the controller 32 can be programmed to cause the robot 24 to carry a substrate 10 from the staging section 176 and place it directly onto a polishing surface of polishing article on a platen of a polishing station. Similarly, for unloading of the substrate from the polisher, the robot 24 can be configured and the controller 32 can be programmed to cause the robot 24 to pick up a substrate 10 directly off a polishing surface of polishing article on a platen of a polishing station, and place it into the staging section 176.

Figure 3A:
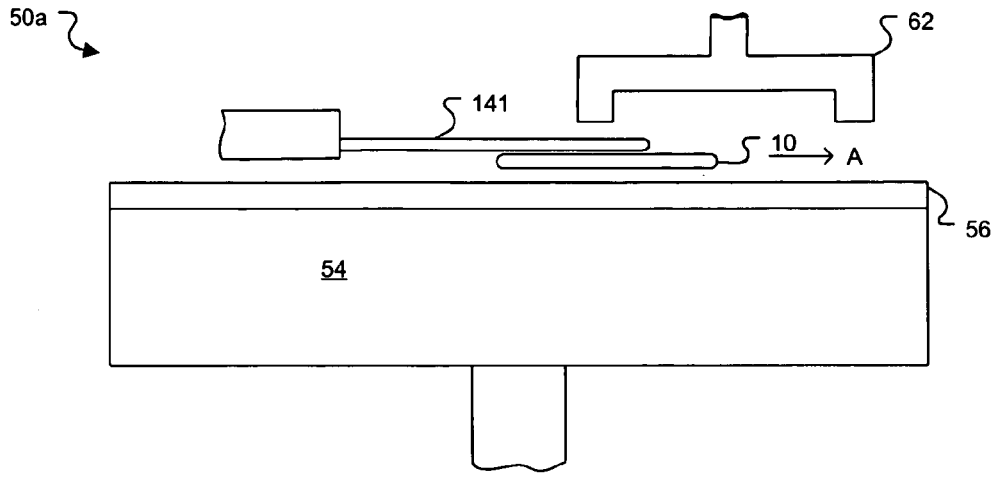
FIGS. 3A–3C are schematic side views illustrating a process of loading a substrate into a polishing station.
Figure 3B:
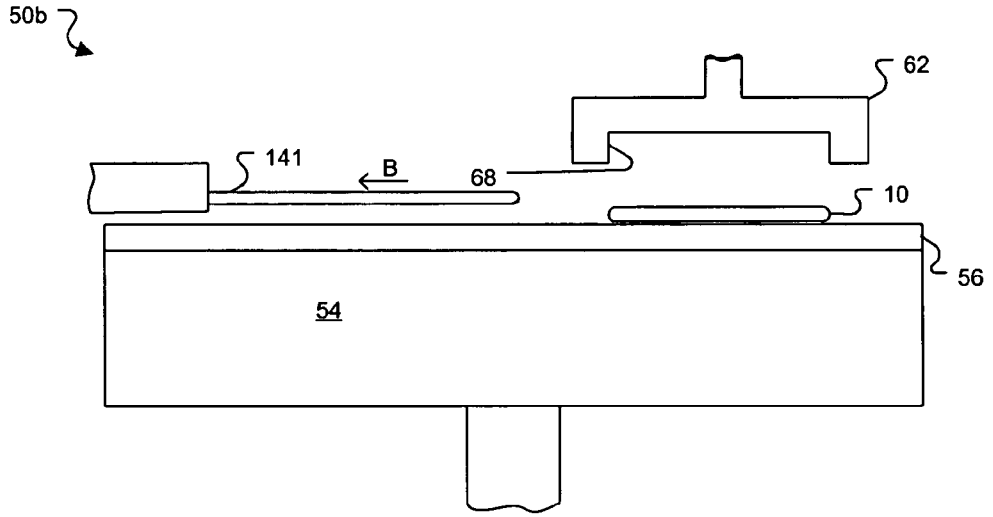
Figure 3C:
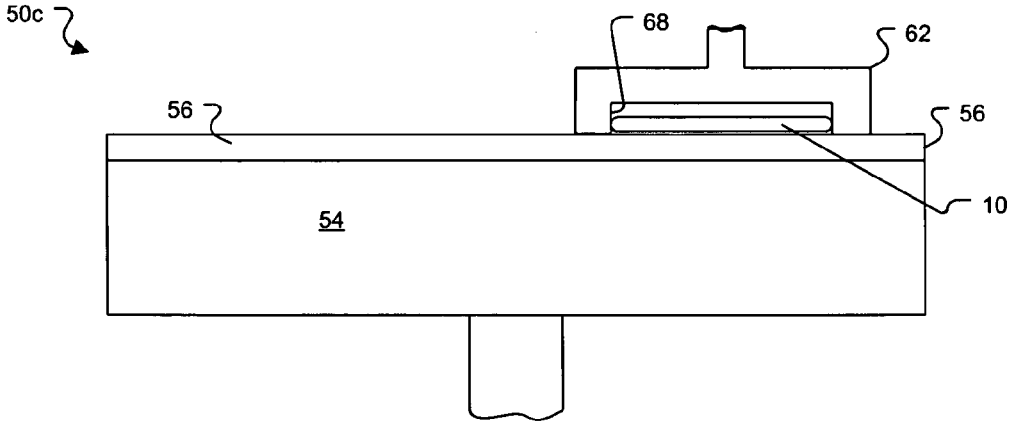

In one implementation, the blade 141 can be vertically positioned between a retracted position of the carrier head 52 and the polishing surface of the polishing article 56. Referring to FIGS. 3A–3C, an implementation of a process for loading a substrate into the polishing station 50*a* is shown. Initially, as shown in FIG. 3A, the mounting surface of the carrier head 62 is retracted, and the blade 141 carries the substrate laterally (shown by arrow A) to a position between the carrier head and the polishing article. Then, as shown in FIG. 3B, the blade lowers the substrate onto the polishing surface, releases the substrate, and retracts (shown by arrow B). Then, as shown in FIG. 3C, the mounting surface of the carrier head 62 is lowered so that the substrate fits in a receiving recess 68 of the carrier head. At this point the substrate can be polished at the polishing station, or vacuum chucked to the carrier head 62 and transported to another polishing station. The process of unloading the substrate 10 from the polishing system basically performs these steps in reverse order.

This configuration provides a significant degree of flexibility in process and substrate flow. For example, in a sequential polishing operation, each substrate 10 can be loaded at the loading station 50*a*, polished at the loading station 50*a*, and carried sequentially to each polishing station 50*b*–50*d* other than the loading polishing station 50*a* for additional polishing, returned to the loading station 50*a*, and then unloaded. For a sequential polishing operation, the polishing conditions can be different at the different polishing stations, e.g., different stations can be configured for polishing of different materials, or for successively finer polishing operations. Alternatively, in a batch polishing operation, N substrates can be loaded in the loading station 50*a* by sequentially different carrier heads, polished at different polishing stations 50*a*–50*d* (without being polished at the other stations), and then returned sequentially and unloaded from the loading station 50*a*. For a batch polishing operation, the substrates at the polishing stations can be polished under substantially similar conditions. As a mixed polishing operation, alternating substrates can be polished using alternating pairs of polishing stations. For example, one substrate can be loaded at the loading station 50*a*, carried to and polished at polishing station 50*b* (without being polished at the loading station 50*a*) carried to and polished at the polishing station 50*d*, and carried to and unloaded from than the loading station 50*a*. The next substrate can be loaded at the loading station 50*a*, polished at the loading station 50*a* (this can be simultaneous with polishing of the first substrate at station 50*b*), carried to and polished at polishing station 50*c* (this can be simultaneous with polishing of the first substrate at station 50*d*), and carried to and unloaded from than the loading station 50*a*.

In the implementation shown in FIG. 1, the robot 24 is located adjacent to the polishing station 50' in order to load the substrate 10 into and retrieve the substrate from a dedicated polishing station 50' (i.e., in this implementation the architecture of the system is such that the robot 24 can only access a single one of the polishing stations).

Figure 4:
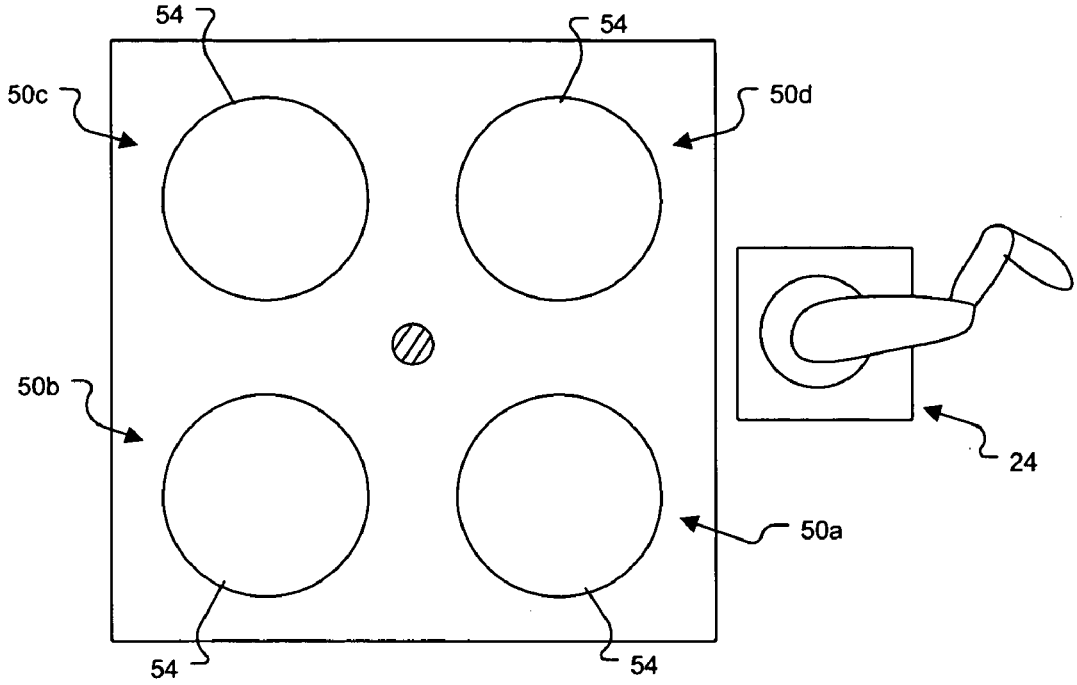
FIG. 4 is a schematic drawing illustrating another implementation of a system to process substrates.

In another implementation, as shown in FIG. 4, the robot 24 can be located between two polishing stations 50, and the architecture of the system is such that the robot 24 access two of the polishing stations. In addition, the robot could be configured to move to between several polishing stations 50 (e.g., via a rail) in order to directly load or unload the substrate into the adjacent polishing station.

In general, the controller 32 is configured to select which of the two polishing stations the substrate is delivered to or retrieved from. For example, the robot 24 can deliver the substrate to one dedicated polishing station 50*a* and retrieve the substrate from a different dedicated polishing station 50*b* (i.e., in this implementation the software of the controller is set such that the robot 24 accesses a single one of the polishing stations for loading and a different single one of the polishing stations for unloading.) As another example, the controller 32 can determine on the fly which polishing station to use for loading or unloading depending on run-time conditions.

As another example, which can be useful for the mixed polishing operation discussed above, the robot 24 loads alternating substrates to and from the two adjacent polishing stations. For example, one substrate polished at the loading station 50*a*, carried to and polished at polishing station 50*c*, and carried to and unloaded from than the loading station 50*a*. The next substrate of the batch can be loaded and polished at the loading station 50*d*, carried to and polished at polishing station 50*b*, and carried to and unloaded from than the loading station 50*d*. In particular, partially polished substrates at stations 50*a* and 50*d* can be carried simultaneously to stations 50*c* and 50*b*, respectively, for additional polishing, by a first rotation of the carousel, while the substrates that were at stations 50*c* and 50*b* are carried back to stations 50*a* and 50*d* for unloading by the same rotation. A second rotation of the carousel returns the polished substrates back to stations 50*a* and 50*d* for unloading, and carries two new partially polished substrate to stations 50*c* and 50*b*. An advantage of this operation is that it requires only two rotations of the carousel per polishing cycle.

Figure 5:
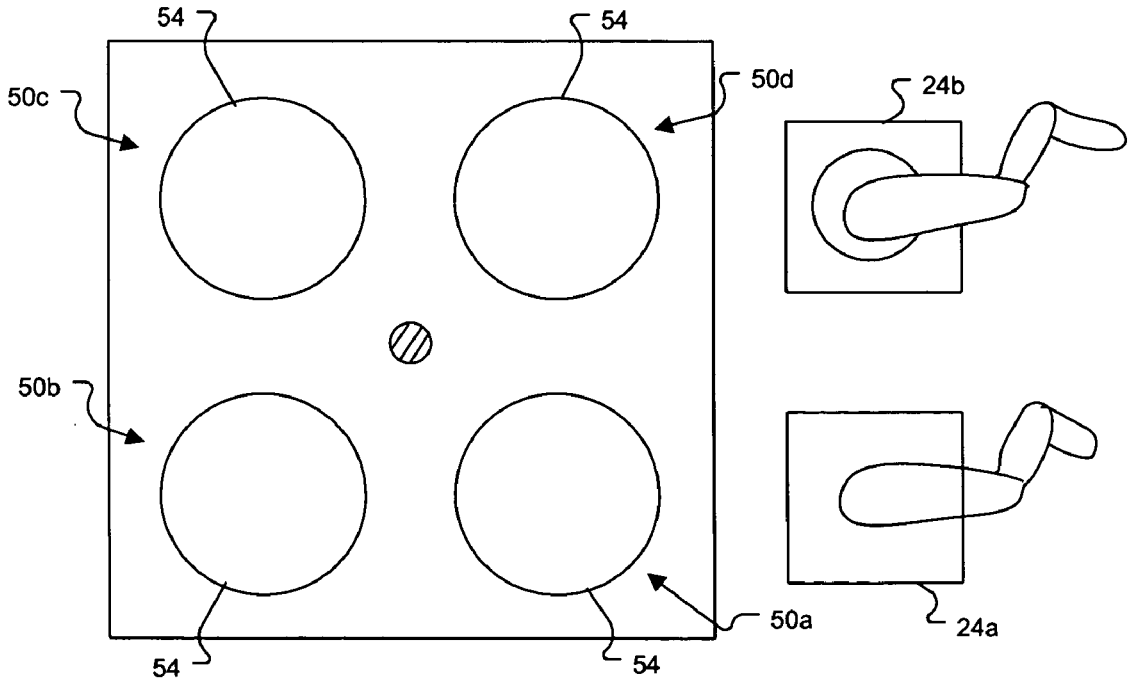
FIG. 5 is a schematic drawing illustrating another implementation of a system to process substrates.

In yet another implementation, illustrated in FIG. 5, the system 20 includes two loading robots 24*a* and 24*b* positioned to access two adjacent different polishing stations, e.g., stations 50*a* and 50*d* respectively. The architecture of the system can be such that each robot can only access a single different one of the polishing stations. In one implementation, the robot a adjacent to polishing station 50*a* is a dedicated loading robot 24*a*, and the robot adjacent to polishing station 50*d* is a dedicated unloading robot 24*b*. This may be applicable for the sequential polishing operation described above (excepting that the substrate is unloaded from station 50*d* rather than station 50*a*), In another implementation, the loading robots 24*a* and 24*b* perform both loading and unloading. This may be applicable to the mixed polishing operation described above with reference to FIG. 4 (excepting that different robots are used for the different stations rather than a common robot).

The controller 32 can include one or more programmable digital computers executing centralized or distributed control software. The controller 32 can coordinate operations of the system 20. In one implementation, the controller 32 manages direct loading of the substrates 10. For example, the control software can use a mapping system that assigns coordinates to a range of motion for the robot 24. A feedback system can provide current coordinates so that the control software can calculate how to reach, for example, a position from which the substrate 10 can be chucked from the platen 54. The controller 32 can produce electrical control signals (e.g., analog or digital signals) to direct the robot 24.

Figure 6A:
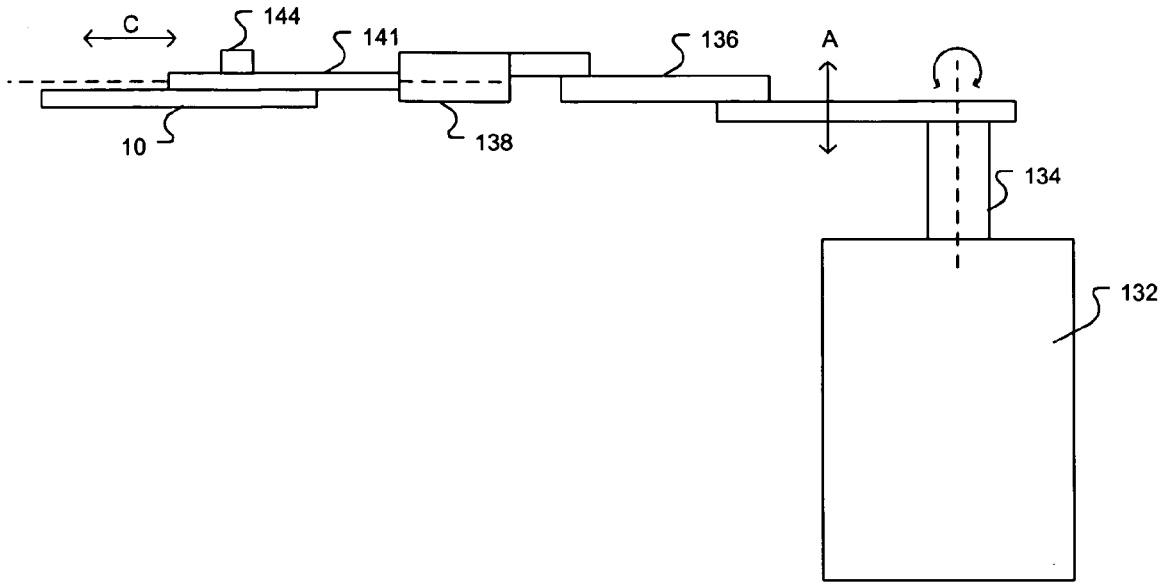
FIGS. 6A–6B are schematic side and top views illustrating a wet robot to directly load substrates into the polisher of FIG. 1.

FIG. 6A is a schematic diagram of one implementation of the robot 24 to directly load substrates 10. The robot 24 has a robot base 132, a vertical shaft 134, and an articulated arm 136 ending in a substrate gripper 141. The vertical shaft 134 is capable of adjusting a height of the substrate. To do so, the vertical shaft 134 raises and lowers the articulated art 136 along a vertical axis as shown by A. The articulated arm 136 is capable of moving the substrate 10 laterally. Specifically, the articulated arm 136 rotates about a vertical axis shown by B. In addition, the articulated arm 136 horizontally extends and retracts as shown by C. In one implementation, the articulated arm includes a rotary actuator 138 is capable of rotating the substrate 10 about a horizontal axis shown by D. The robot 24 thus provides a wide range of motion to move the substrate between the staging section 176 and the loading polishing station 50*a*.

Figure 6B:
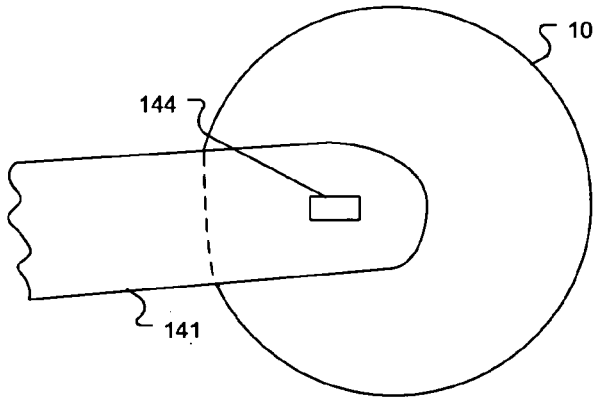

FIG. 6B is a bottom view of the articulated arm 136. The substrate gripper 141 can be a vacuum chuck, e.g., a blade, an electrostatic chuck, an edge clamp, or similar wafer gripping mechanism. The substrate gripper 141 secures the substrate 10 while being transferred by the robot 24. The substrate gripper 141 can secure the substrate 10 in an upside down position and during motion of the articulated arm 136.

In one implementation, loading (and unloading) is assisted by one or more implementations of a positioning system described below in association with FIGS. 7–10.

The polisher 22 can have one or more components to assist in positioning the substrate 10 on the loading polishing station 50*a*, examples of which are described in FIGS. 7–10. In general, the components of a positioning system can include hardware and/or software. The hardware aspects can be used to physically position the substrate 10 to a target chucking position (i.e., within a range of positions from which the substrate 10 can be safely chucked by the polishing head 62). The software aspects can be used to control the hardware aspects with instructions configured to, for example, calculate a current position and determine movements necessary to reach the chucking position. In some implementations, the articulated arm 136 can be calibrated to place the substrate 10 directly at the chucking position. For example, a feedback process can guide the articulated arm 136 as described below. In some implementations, the articulated arm 136 can place the substrate 10 on the platen 54, and then the platen 54 can be repositioned to the chucking position (e.g., by rotating the platen 54). In other implementations, an adjustment mechanism can reposition the substrate 10 from an initial placement by the articulated arm 136 (e.g., from an out of range position) to the target chucking position.

Figure 7:
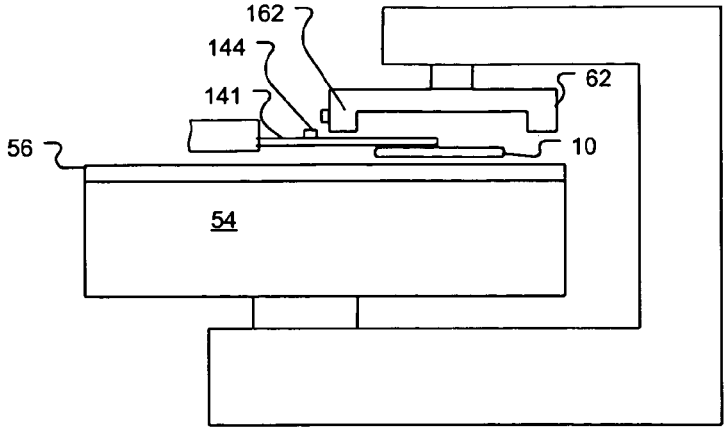
FIG. 7 is a schematic diagram illustrating a first implementation of a positioning mechanism associated with direct loading.

FIG. 7 is a schematic diagram of the polisher 22 with a first implementation of a positioning system that uses feedback to control the position of the articulated arm 136 during placement of the substrate. In one implementation of a positioning mechanism, one or both of the robot 24 and the polisher 22 can include a positioning sensor to determine the position of the articulated arm 136 relative to the components of the polisher 22. For example, the positioning sensor 144 can be located on the articulated arm 136, on the blade 141, on the carousel 60, or the carrier head 62. In one implementation, one of the robot 24 or polisher 22 can include a position sensor 144, and the other component (e.g., on the carrier head 62 if the sensor 144 is on the blade) can include features 162, e.g., alignment patterns such as reflective strips or light sources such as LEDs, that improve ease of detection. The position sensor 144 can be an optical detector (e.g., a photodetector), a camera, an edge detector, and the like. In one implementation, an optical detector detects light from a light source 162 mounted on the other component to determine whether the substrate has reached the chucking position. In another implementation, a camera uses image processing for visual recognition of the chucking position. FIGS. 6A–6B illustrate an example of the position sensor 144 on the robot 24, whereas FIG. 7 illustrates an example of a position sensor distributed between the robot 24, e.g., the blade 141, and the polishing system 22, e.g., the carrier head 62. Although illustrated on the top surface of the blade 141, the sensor 144 could be positioned on the bottom surface.

The position sensor 144 can provide feedback information. The position sensor 144 can output to, for example, control software or hardware (e.g., the controller 32) that calculates position and determines how to reach the chucking position. The articulated arm 136 can receive a signal that directs further movement. For example, if a camera is used, the controller can be configured to move the blade to cause the image from the camera to match a predetermined target image at which the blade 141 will be properly positioned.

In one implementation, the articulated arm 136 is extendable along a constrained axis (i.e., has one degree of freedom) and can be positioned to the chucking position with a single position sensor 144. In other implementations, the articulated arm 136 is extendable along more than one axis and thus positions with more than one position sensor 144. The feedback process can continue until the chucking position is reached. The articulated arm 136 releases the substrate 10 after being positioned on the polishing article 56.

Figure 8A:
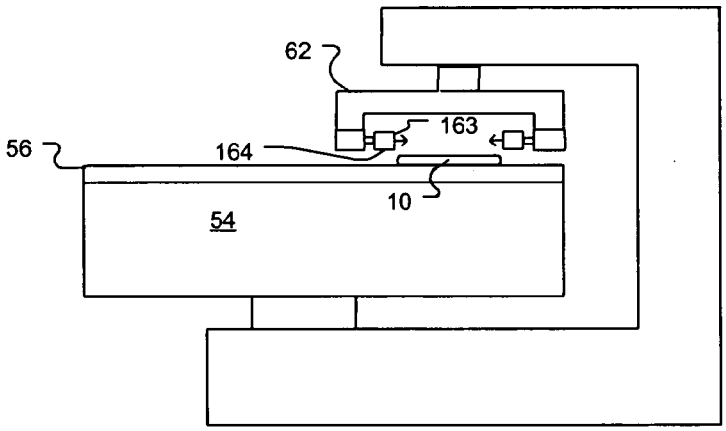
FIGS. 8A–8B are schematic side and top views illustrating a second implementation of a positioning mechanism associated with direct loading.
Figure 8B:
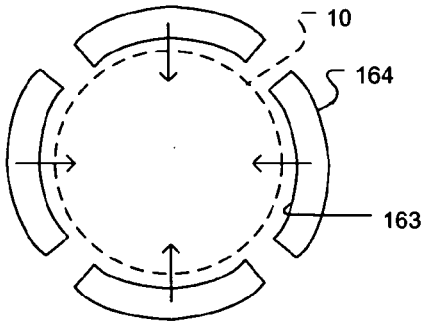

FIGS. 8A and 8B are schematic diagrams of the polisher 22 with a second implementation of a positioning system with a first implementation of an adjustment mechanism. In FIG. 8A, the carrier head 62 includes a retaining ring 164. FIG. 8B shows a bottom view of the retaining ring 164 (i.e., an implementation of an annular retaining ring). The retaining ring 164 has an adjustable inner diameter 163. In operation, the inner diameter can be increased while the carrier head 62 is lowered. The increased diameter 163 relaxes a tolerance associated with the position at which the substrate 10 is placed by the robot 24. Once the carrier head is lowered, the inner diameter 163 of the retaining ring 164 decreases to gently urge the substrate 10 inwardly. For example, if the substrate 10 is off-center relative to the inner diameter 163, a corresponding part of the retaining ring 164 can nudge the substrate 10 to meet or almost meet an opposite side of the retaining ring 164. After polishing, the adjustable diameter of the retaining ring 164 can again increase to release the substrate 10. A retaining ring with an adjustable inner diameter is described in U.S. Pat. No. 6,436,228, which is incorporated by reference.

Figure 9A:
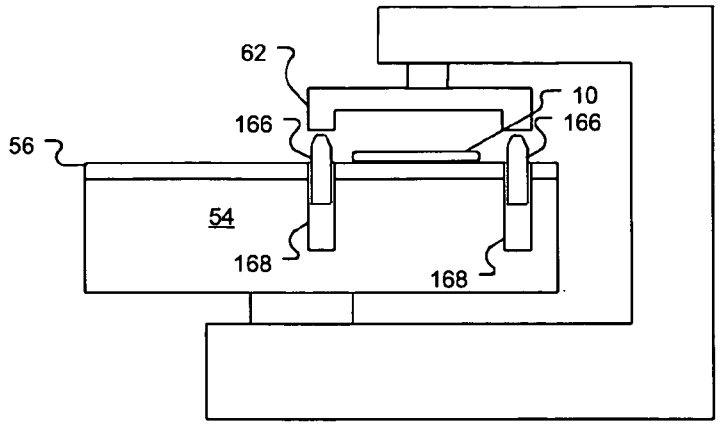
FIGS. 9A–9B are schematic diagrams cross-sectional side views illustrating a third implementation of a positioning mechanism associated with direct loading.
Figure 9B:
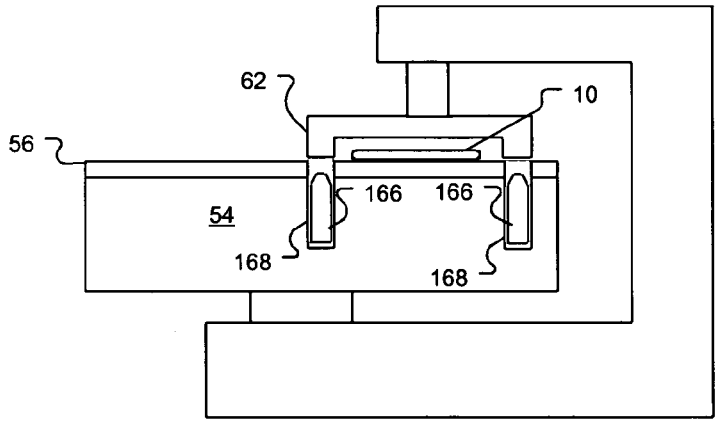
Figure 9C:
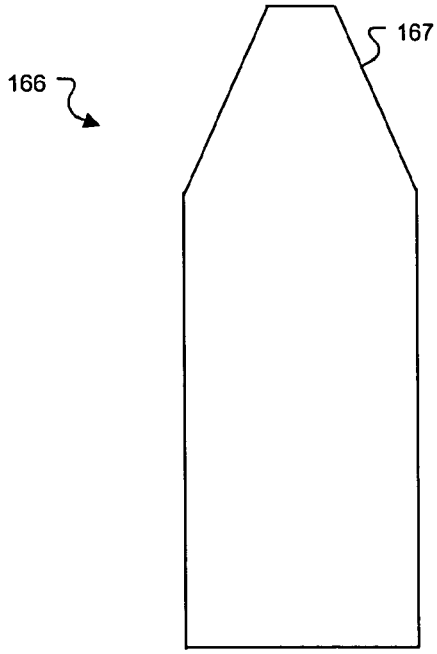
FIG. 9C is a schematic side view of an alignment pin from the positioning mechanism of FIGS. 9A–9B.

FIGS. 9A–9C are schematic diagrams of the polisher 22 with a third implementation of a positioning system with a second implementation of an adjustment mechanism. The platen 54 includes retractable alignment pins 166 positioned around a chucking position. The retractable pins 166 can be attached to an actuator (not shown) within the platen 54, and when retracted can rest in recesses 168 in the platen 54. When actuated upwardly, the pins 166 extend through holes in the polishing article 56 so that they project above the polishing surface. In one implementation, three retractable pins 166 are placed at 120-degree increments around a circumference of the chucking position. In another implementation, there can be a different number of retractable pins 166.

As shown in FIG. 9C, the inward facing surface (i.e., the surface facing the substrate) at the tops of each retractable pin 166 can be tapered 167 (as shown, the entire pin can be tapered) such that a top portion of the retractable pin corresponds to a larger substrate diameter than a lower portion. Alternatively, the retractable pins 166 can be non-tapered but be positioned with their longitudinal axes at a non-normal angle relative to the polishing surface, resulting in a similar progression in diameter size.

In operation, the retractable pins 166 can be lowered to allow the substrate 10 to be placed on the polishing article 56 without interference. The substrate 10 can be placed using various techniques (e.g., using the positioning sensor 144 as described above in association with FIG. 7). The retractable pins 166 can be activated to emerge from the platen 54 responsive to the substrate being sensed (e.g., as notified by a controller or as determined by a light sensor placed below the substrate 10). The tapered edges 167 of the retractable pins 166 are configured to contact the edge of the substrate and gently reposition the substrate 10 from an original location to the chucking position. The retractable pins 166 can then retract into the platen 54 to avoid interfering with the carrier head 62 when lowered to chuck the substrate 10.

Figure 10A:
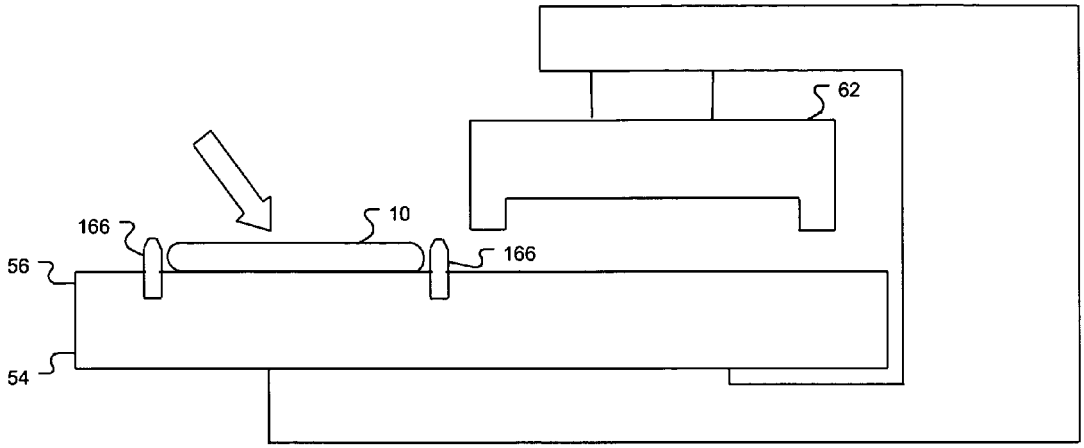
FIGS. 10A–B are schematic diagrams illustrating a fourth implementation of a positioning mechanism associated with direct loading.
Figure 10B:
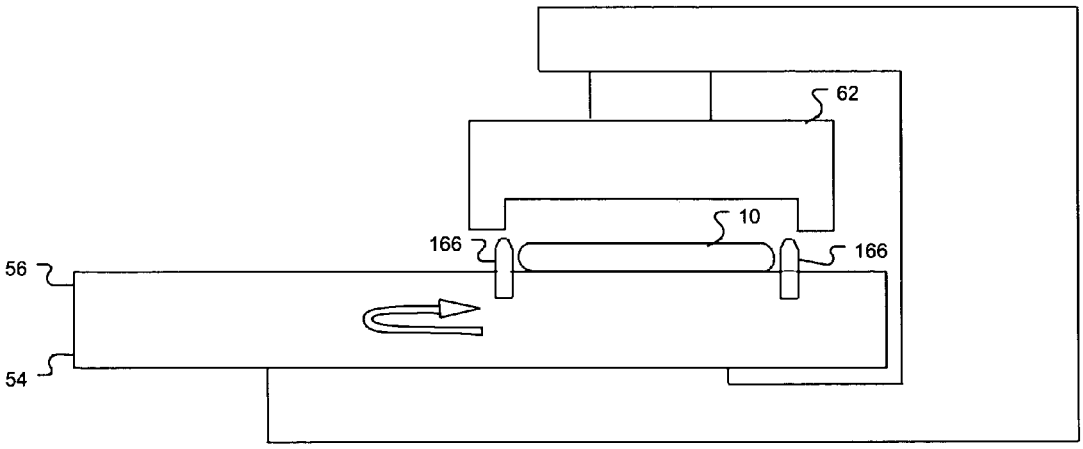

FIGS. 10A and 10B are schematic diagrams of the polisher 22 with a fourth implementation of a positioning mechanism. In this implementation, the platen 54 rotates between a loading position shown in FIG. 10A and a securing position shown in FIG. 10B. In the loading position, the substrate 10 can be placed by the robot 24 between the retractable pins 166 without a need to maneuver the blade 141 under the carrier head 62. After loading, the platen 54 rotates towards the chucking position, thereby positioning the substrate 10 for chucking by the carrier head 62.

A number of embodiments of the invention have been described. Nevertheless, it will be understood that various modifications may be made without departing from the spirit and scope of the invention. Accordingly, other embodiments are within the scope of the following claims.

Accordingly, other embodiments are within the scope of the following claims.

What is claimed is:

1. A chemical mechanical polishing apparatus, comprising:

a carousel having N (where N≦2) polishing heads, the N polishing heads positioned at substantially equal angles around an axis of rotation of the carousel;

N platens, including a loading platen, each of the N platens configured to support a polishing article, the N platens positioned at substantially equal angles around the axis of rotation of the carousel, such that each polishing head can position a substrate in contact with a polishing article at an associated platen; and a robot located proximate to the loading platen and configured to position a substrate on the polishing article at the loading platen for loading into a polishing head from the N polishing heads.

2. The apparatus of claim 1, wherein the N polishing heads are rotatable.

3. The apparatus of claim 1, wherein the robot is configured to position the substrate only at the loading platen.

4. The apparatus of claim 1, wherein the robot is configured to position the substrate at one of a plurality of platens from the N platens.

5. The apparatus of claim 1, wherein the robot is configured to retrieve a substrate from the loading platen.

6. The apparatus of claim 1, wherein the robot is configured to retrieve a substrate from a platen other than the loading platen.

7. The apparatus of claim 1, further comprising another robot located proximate to a second platen other than the loading platen and configured to position a substrate on the polishing article at the second platen for loading into another polishing head from the N polishing heads.

8. The apparatus of claim 1, further including a first positioning sensor to notify the robot that a substrate has reached a first desired position along a first dimension associated with the loading platen.

9. The apparatus of claim 8, further including a second positioning sensor to notify the robot that a substrate has reached a second desired position along a second dimension associated with the loading platen.

10. The apparatus of claim 8, wherein the first positioning sensor is coupled to the robot.

11. The apparatus of claim 8, wherein the first positioning sensor is coupled to one or more of the carousel or carrier head.

12. The apparatus of claim 8, further including:

a controller, in communication with the first positioning sensor and the robot, the controller configured to receive a feedback signal from the first positioning sensor responsive to a position and, in response, send a position signal to the robot that directs movement of the robot.

13. The apparatus of claim 1, further including:

means for adjusting a position of a substrate after being released by the robot and before being chucked by one of the N polishing heads.

14. The apparatus of claim 13, wherein the polishing head includes a retaining ring configured to adjust from a first diameter to a second diameter that is smaller than the first diameter.

15. The apparatus of claim 14, wherein the adjustable ring is configured to unload the substrate by adjusting from the second diameter to the first diameter.

16. The apparatus of claim 13, wherein the loading platen includes a set of alignment pins to more accurately position the substrate for loading by repositioning the substrate.

17. The apparatus of claim 16, wherein the alignment pins are retractable into the platen.

18. The apparatus of claim 17, wherein a spacing between inner surfaces of the alignment pins provides a dimension that is larger at a top than a bottom of the alignment pints.

19. The apparatus of claim 1, wherein the loading platen is rotatable to a loading position for access that is not obstructed by the carrier head, and the loading platen is rotatable to a chucking position for access by the carrier head.

20. The apparatus of claim 1, further comprising:

a base, wherein the carousel and the N platens are each coupled to the base for support.

21. A chemical mechanical polishing apparatus, comprising:

a polishing head;

a platen configured to support a polishing article;

a robot located proximate to the platen and configured to position a substrate on the polishing article; and an adjustment mechanism having a moveable element to engage the substrate at a first position and move to reposition the substrate to a second position laterally displaced from the first position, the second position being within a range of positions for the polishing head to chuck the substrate from the polishing article on the platen, the first position including positions that are out of the range.

22. The apparatus of claim 21, wherein the moveable element includes a retaining ring configured to adjust from a first diameter to a second diameter that is smaller than the first diameter.

23. The apparatus of claim 21, wherein the moveable element includes a set of alignment pins retractable into the platen.

24. The apparatus of claim 21, wherein the platen is rotatable to a loading position for access that is not obstructed by the carrier head, and the platen is rotatable to a loading position for access by the carrier head.

25. A chemical mechanical polishing apparatus, comprising:

a platen to support a polishing article;

a robot located proximate the platen and configured to position a substrate on the polishing article;

a carrier head having a retaining ring;

a carrier head support mechanism configured to move the carrier head into a position that the retaining ring surrounds the substrate; and a controller configured to control the robot to position the substrate on the polishing article before the retaining ring contacts the polishing article.

26. A method of operating a polishing system, comprising:

placing a substrate onto a polishing surface with a robot;

bringing at least a portion of a carrier head into a loading position such that a retaining ring of the carrier head contacts the polishing surface after the substrate is placed onto the polishing surface, and surrounds the substrate; and causing relative motion between the carrier head and the polishing surface so as to polish the substrate.

27. The method of claim 26, wherein the substrate is placed onto the polishing surface at a first position, and further comprising moving the substrate from the first position to the loading position.

28. The method of claim 27, wherein moving the substrate includes adjusting a diameter of an inner surface of the retaining ring.

29. The method of claim 27, wherein moving the substrate includes contacting an edge of the substrate with an alignment pin.

30. The method of claim 27, wherein moving the substrate includes moving the platen.

31. The method of claim 26, further comprising chucking the substrate with the carrier head, moving the carrier head with the substrate to another polishing surface, and polishing the substrate with the another polishing surface.

32. The chemical mechanical polishing apparatus of claim 25, wherein the robot includes:

an articulated arm having a substrate gripper to secure the substrate during motion of the robot; and a vertical shaft operable to adjust a vertical position of the articulated arm relative to the polishing article or the carrier head.

33. The chemical mechanical polishing apparatus of claim 25, further comprising a positioning sensor to determine whether the substrate has reached the position.

34. The chemical mechanical polishing apparatus of claim 25, wherein the retaining ring includes an adjustable inner diameter that provides a predetermined position tolerance associated with the position at which the substrate is placed by the robot.

35. The method of claim 26, further comprising transferring the substrate from the polishing surface to a different polishing surface using a different robot.

36. The method of claim 26, further comprising postioning a different substrate onto the polishing surface after transferring the substrate to a different polishing surface polishing station.

37. The chemical mechanical polishing apparatus of claim 23, wherein each retractable alignment pin includes tapered edges such that a top portion of the retractable alignment pin provides a larger substrate diameter than that of a lower portion of the retractable alignment pin.

* * * * *